US005376618A

United States Patent [19]

Uytterhoeven et al.

[11] Patent Number: 5,376,618

[45] Date of Patent: Dec. 27, 1994

[54] THERMAL DYE SUBLIMATION TRANSFER RECEIVING ELEMENT

[75] Inventors: Herman J. Uytterhoeven, Bonheiden; August M. Mariën, Westerlo, both of Belgium

[73] Assignee: AGFA-Gevaert, N.V., Mortsel, Belgium

[21] Appl. No.: 774,191

[22] Filed: Oct. 10, 1991

[30] Foreign Application Priority Data

Oct. 17, 1990 [EP] European Pat. Off. ..... 90202760

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227; 528/272, 305, 308.6

[56] References Cited

U.S. PATENT DOCUMENTS

| | | | |
|---|---|---|---|
| 4,990,485 | 2/1991 | Egashira et al. | 503/227 |
| 5,124,309 | 6/1992 | Egashira | 503/227 |
| 5,258,353 | 11/1993 | MacDonald et al. | 503/227 |

*Primary Examiner*—B. Hamilton Hess
*Attorney, Agent, or Firm*—Breiner & Breiner

[57] ABSTRACT

Dye-image receiving element for use according to thermal dye sublimation transfer comprising a support having thereon a dye-image receiving layer containing a (co)polyester comprising condensation residues of one or more diols and one or more dicarboxylic acids and further comprising condensation residues of one or more hydroxy-carboxylic acids containing a long chain alkyl or alkylene group having at least 8 carbon atoms.

10 Claims, No Drawings

THERMAL DYE SUBLIMATION TRANSFER RECEIVING ELEMENT

The present invention relates to dye-image receiving elements for use according to thermal dye sublimation transfer.

Thermal dye sublimation transfer also called thermal dye diffusion transfer is a recording method in which a dye-donor element provided with a dye layer containing sublimable dyes having heat transferability is brought into contact with a dye-image receiving element and selectively, in accordance with a pattern information signal, heated with a thermal printing head provided with a plurality of juxtaposed heat-generating resistors, whereby dye from the selectively heated regions of the dye-donor element is transferred to the dye-image receiving element and forms a pattern thereon, the shape and density of which is in accordance with the pattern and intensity of heat applied to the dye-donor element.

A dye-image receiving element for use according to thermal dye sublimation transfer usually comprises a support, e.g. paper or a transparant film, coated with a dye-image receiving layer, into which the dye can diffuse more readily. An adhesive layer may be provided between the support and the receiving layer.

The dye-image receiving layer may comprise a binder, for example, a polycarbonate, a polyurethane, a polyester, a polyamide, a polyvinyl chloride, a polystyrene-co-acrylonitrile, a polycaprolactone or mixtures thereof.

A generally used binder is (co)polyester obtained by (co)polycondensation between one or more dicarboxylic acids and one or more diols. Preferably at least one of the dicarboxylic acids and/or diols contains an aromatic moiety so that the glass transition point of the (co)polyester is at least 0° C., preferably at least 20° C.

Such polyester receiving layers are described in e.g. EP 289161, EP 275319, EP 261505, EP 368318, JP 86/3796 and JP 89/269589.

In the polyester image receiving layer of the prior art, dyeability is not necessarily sufficiently good, and when an image with high density is desired, a correspondingly excessive heat content is required during printing. For this reason the energy load on the thermal head is inevitably increased, whereby the thermal head driving voltage becomes disadvantageously great.

Furthermore when the donor element and the receiving element are peeled apart after the heat transfer has been effected, the donor layer adheres to the receiving layer and thus is peeled to be transferred thereonto, whereby both the sheets will never be fit for use. Therefore in order to improve the anti-sticking properties of the image receiving layer a release agent is generally incorporated in the image-receiving layer of the prior art or in a topcoat on this image receiving layer.

It is an object of the present invention to provide a polyester dye-image receiving layer of excellent dyeability.

It is another object of the present invention to provide a polyester dye-image receiving layer with improved release properties without the necessity of incorporating a separate release agent in the image receiving layer or in a layer on top of the image receiving layer.

Other objects will become apparent from the description hereinafter.

In accordance with the present invention a dye-image receiving element for use according to thermal dye sublimation transfer is provided, said dye-image receiving element comprising a support having thereon a dye-image receiving layer containing a (co)polyester comprising condensation residues of one or more diols and one or more dicarboxylic acids characterized in that said (co)polyester further comprises condensation residues of one or more hydroxy-carboxylic acids containing a long chain alkyl or alkylene group having at least 8 carbon atoms.

The present hydroxy-carboxylic acids thus contain a non-branched alkyl or alkylene group with a total of at least 8 carbon atoms or a branched alkyl or alkylene group with a total of at least 8 carbon atoms.

Preferably the long chain alkyl or alkylene group contains 10 or more carbon atoms.

The long chain alkyl or alkylene group may be incorporated in the main chain of the hydroxy-carboxylic acid, possibly connected to the hydroxy or carboxylic functionalities via linking groups e.g. via aromatic moieties and alicyclic moieties, and via hetero atoms (e.g. —O—, —NH—, —O—CO—, —NH—CO—) bonded to said moieties. Alternatively the long chain alkyl or alkylene group may be incorporated in a side-chain of the hydroxy-carboxylic acid e.g. as a substituent of an aromatic moiety of the main chain or bonded via a linking group such as —O—, —NH—, —O—CO— and —NH—CO— to the main chain.

In this latter case or if the branching is long enough (for example, containing at least 6 carbon atoms in the side chain) in the case of a branched alkyl or alkylene group, apart from improved dyeability, the peeling apart from the receiving element and the donor element after the dye transfer is improved due to improved anti-sticking properties of the dye receiving element.

Examples of the present hydroxy-carboxylic acids containing a long chain alkyl or alkylene group include methyl-n-hexylglycolic acid, 2,3-dihydroxynonanoic acid, 11-hydroxyundecanoic acid, 2-hydroxy-4,6,6-trimethylheptanoic acid, 16-hydroxyhexadecanoic acid, 12-hydroxystearic acid, 12-hydroxy-9-octadecenic acid (=ricinoleic acid), 12,13-epoxy-9-octadecenic acid, anacardic acid. Of these 12-hydroxystearic acid and ricinoleic acid are particularly preferred.

Besides these long chain containing hydroxy-carboxylic acids other hydroxy-carboxylic acids can be incorporated in the polyester. Examples of these hydroxy-carboxylic acids are listed hereinafter: hydroxyacetic acid, Beta-hydroxypropionic acid, Gamma-hydroxybutyric acid, 2,3-dihydroxybutyric acid, Delta-hydroxyvaleric acid, Alpha-hydroxy-Alpha-methylbutyric acid, Beta-hydroxyisovaleric acid, 2,3-dihydroxypentanoic acid, Alpha-hydroxycaproic acid, Epsilon-hydroxycaproic acid, Alpha-hydroxy-Alpha-methylvaleric acid, Beta,Beta,Beta-trimethyllactic acid, 2,3-dihydroxyhexanoic acid, methyl-n-butylglycolic acid, 4-hydroxycyclohexanecarboxylic acid, trans-cyclopentanol-2-acetic acid, Alpha-hydroxycaprilic acid, methyl-n-amylglycolic acid, methyl-neopentylglycolic acid, trans-cyclohexanol-2-acetic acid, 1-hydroxy-4-methylcyclohexanecarboxylic acid, o-hydroxybenzoic acid, m-hydroxybenzoic acid, p-hydroxybenzoic acid, 2,4-dihydroxybenzoic acid, 2,5-dihydroxybenzoic acid, 3,4-dihydroxybenzoic acid, Alpha-hydroxyphenylacetic acid, o-hydroxyphenylacetic acid and m-hydroxyphenylacetic acid.

The (co)polyester of the present invention may be obtained by condensing one or more dicarboxylic acids with one or more diols including aromatic and aliphatic dicarboxylic acids and diols and including one or more of the present hydroxy-carboxylic acids containing a long chain alkyl or alkylene group. The condensation can also be carried out by using derivatives of the dicarboxylic acids in the form of their corresponding esters and/or derivatives of the diols in the form of their corresponding epoxides or in the form of their corresponding acetates.

Preferably at least one of the condensation residues contains an aromatic moiety.

Examples of aromatic dicarboxylic acids include terephthalic acid, isophthalic acid, sulfoisophthalic acid, orthophtalic acid, t-butylisophthalic acid, 4,4'-oxybisbenzoic acid, 2,5-, 2,6- or 2,7-naphthalenedicarboxylic acid, 4,4-diphenyldicarboxylic acid, dipicolinic acid and 2,2-bis(p-carboxyphenyl)propane.

Examples of aromatic diols include bisphenol A, ethoxylizied bisphenol A (e.g. Dianol 22 supplied by Akzo), propoxylized bisphenol A (e.g. Dianol 33 supplied by Akzo), p-xylyleneglycol, 5-sodium sulforesorcine.

Examples of aliphatic dicarboxylic acids include malonic acid, succinic acid, glutaric acid, adipic acid, itaconic acid, maleic acid, 1,4-cyclohexanedicarboxylic acid.

Examples of aliphatic diols include ethylene glycol, diethyleneglycol, triethyleneglycol, neopentylglycol, 1,4-butanediol, 1,2-propanediol, 1,3-propanediol, 1,2-hexanediol, 1,6-hexanediol, 1,4-cyclohexanedimethanol, 1,4-cyclohexanediol, 2,2'-bis(4-hydroxycyclohexyl)propane.

Apart from the above mentioned diols and dicarboxylic acids there can be incorporated in the polyester small amounts of diols and/or dicarboxylic acids containing long chain alkyl or alkylene groups to further enhance the dyeability.

Examples of said diols containing a long chain alkyl or alkylene group include 1,8-octanediol, 1,2-octanediol, 1,9-nonanediol, 1,2-decanediol, 1,10-decanediol, 1,11-undecanediol, 1,12-dodecanediol, 1,2-dodecanediol, 1,13-tridecanediol, 1,14-tetradecanediol, 1,15-pentadecanediol, 1,2-hexadecanediol, 1,16-hexadecanediol, 1,17-heptadecanediol, 1,12-octadecanediol, 1,4-octadecanediol, 1,18-octadecanediol, 1,2-epoxyoctadecanediol, 1,19-nonadecanediol, 1,20-eicosanediol, 1,21-heneicosanediol, 1,22-docosanediol, 1,25-pentacosanediol, N,N-di(hydroxyethyl)stearic amide, N,N-di(n-decyl)amino-2,3-propanediol, 9-octadecene-1,12-diol, 4,4-bis(4-hydroxyphenyl)-1-n-dodecane, glycerine mono stearate, glycerine mono oleate, glycerine mono ricinoleate, glycerine mono laurate, glycerine mono caprylate, pentaerytritol distearate, 4-n-dodecylresorcinol, cardol, dimer fatty alcohols, sorbitan fatty acid esters (e.g., sorbitan stearate, sorbitan oleate and sorbitan palmitate).

Examples of said dicarboxylic acids containing a long chain alkyl or alkylene group include sebacic acid, azelaic acid, decane dicarboxylic acid, undecane dicarboxylic acid, dodecane dicarboxylic acid, tridecane dicarboxylic acid, tetradecane dicarboxylic acid, heptadecane dicarboxylic acid, octadecane dicarboxylic acid, nonadecane dicarboxylic acid, eicosane dicarboxylic acid, docosane dicarboxylic acid, tetradecylmalonic acid, hexadecylmalonic acid, octadecylmalonic acid, diheptylmalonic acid, octylsuccinic acid, decylsuccinic acid, dodecylsuccinic acid, tetradecylsuccinic acid, hexadecylsuccinic acid, octadecylsuccinic acid, octenylsuccinic acid, iso-octenylsuccinic acid, decenylsuccinic acid, dodecenylsuccinic acid, tetradecenylsuccinic acid, hexadecenylsuccinic acid, octadecenylsuccinic acid, docosylsuccinic acid, docosenylsuccinic acid, tetrapropenylsuccinic acid, triacontenylsuccinic acid, polyisobutenylsuccinic acid, dimer fatty acids and derivatives such as PRIPOL 1008/1009 (CAS registry no. 68783-41-5) which is a mixture of aromatic, cycloaliphatic and aliphatic $C_{36}$ dimer fatty acid isomers and PRIPLAST 3008 (CAS registry no. 68956-10-5) which is the dimethyl ester of said dimer acid, PRIPOL 1004 which is a $C_{44}$ dimer fatty acid (all supplied by Unichema), EMPOL supplied by Quantum Chemicals which is a $C_{36}$ aliphatic dimer acid and UNIDYME 14 supplied by Union Camp.

The polyester resins for use according to the present invention can be prepared by the condensation polymerisation reactions known in the art. In the case of polyester containing one or more double bonds inhibitors can be added to avoid crosslinking and/or side-reactions.

The present hydroxy-carboxylic acids are preferably incorporated in the polyester in an amount of between 1 and 60 mole % of the total diol and dicarboxylic acid content, preferably between 5 and 25 mole %, more preferably between 5 and 10 mole %.

The molecular weight of the polyester binder according to the present invention is preferably about 1000 to 10000. The molecular weight can be increased by adding during the polycondensation reaction small amounts (for example approximately 0.1 mole %) of a trifunctional or tetrafunction product e.g. a compound corresponding to the following structure

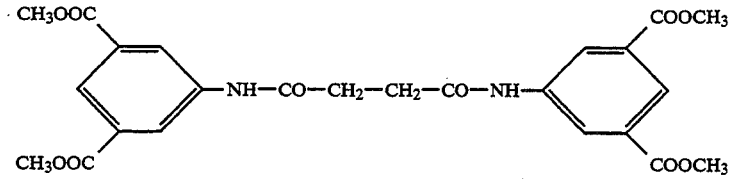

Preferably a solubilizing group such as $COO^-$, $SO_3^-$, $O^-$ or a polyethyleneoxide chain is incorporated in the (co)polyester either via one of the dicarboxylic acids (e.g. sulfoisophthalic acid, sulfoterephthalic acid, sulfo-orthophthalic acid) or via one of the diols (e.g. Tegomer DS 3117 corresponding to formula (a) below or Tegomer D 3403 corresponding to formula (b) below, both supplied by Goldschmidt) with the advantage that an aqueous application of the image receiving layer to the support is then easily conducted. Examples of such solubilizing groups are described in EP 368318 and JP 86/3796.

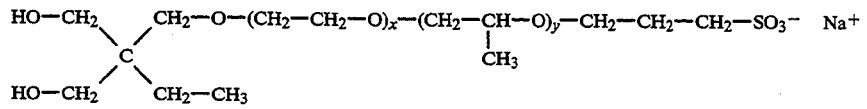

(a)

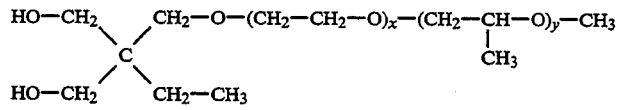

(b)

Preferred (co)polyester resins of the present invention are indicted below in Table 1, but the invention is not limited thereto.

TABLE 1

| No. | TPA | IPA | SIPA | EG | DIA22 | HDD | ODSUC | LCA |
|---|---|---|---|---|---|---|---|---|
| 1 | 42 | 37 | 16 | 74 | 21 | | | HSA = 10 |
| 2 | 47 | 32 | 16 | 75 | 20 | | | HSA = 10 |
| 3 | 44 | 32.5 | 16 | 72.5 | 20 | | | HSA = 15 |
| 4 | 47 | 32 | 16 | 70 | 20 | 5 | | HSA = 10 |
| 5 | 45 | 31.5 | 16 | 75 | 20 | | 2.5 | HSA = 10 |

The designations TPA, IPA, SIPA, EG, DIA22, HDD, ODSUC and LCA represent components from which the units of the polyester are derived and these designations are as defined below.

| | |
|---|---|
| TPA | terephthalic acid |
| IPA | isophthalic acid |
| SIPA | 5-sulfoisophthalic acid sodium salt |
| EG | ethyleneglycol |
| DIA22 | Dianol 22 supplied by Akzo (an ethoxylized bisphenol A) |
| HDD | 1,2-hexadecanediol |
| ODSLC | octadecylsuccinic acid |
| LCA | the present hydroxy-carboxylic acid with the long chain alkyl or alkylene group with as examples HSA 12-hydroxystearic acid |

The numerical values in the Table above indicate the amount of diol or dicarboxylic acid residue in the (co)polyester composition in mole % with respect to the total diol respectively dicarboxylic acid content. Half of the amount of the hydroxy-carboxylic acid residue is indicated in mole % with respect to the total dicarboxylic acid content and half of the amount of the hydroxy-carboxylic acid residue is indicated in mole % with respect to the total diol content.

The polyester resins of the present invention are preferably coated in an amount of from 0.5 gram to 100 grams per square meter of the support, preferably from 1 to 10 g/m$^2$.

Mixtures of the present (co)polyester resins can be used in the present invention, and mixtures of these resins and other known dye receiving resins can also be used.

For example, synthetic resins (a) to (e) shown below can be used singly or as a mixture of two or more kinds in combination with the present (co)polyester resin.

(a) Those having ester bonds: polyester resins, polyacrylic ester resins, polycarbonate resins, polyvinyl acetate resins, styrene-acrylate resins, vinyl toluene-acrylate resins, etc.

(b) Those having urethane bonds: polyurethane resins, etc.

(c) Those having amide bonds: polyamide resins (d) Those having urea bonds: urea resins, etc.

(e) Others having highly polar bonds: polycaprolactone resins, polystyrene resins, polyvinyl chloride resins, polyacrylonitrile resins, cellulose derivatives, etc.

Examples of such resins are described in, e.g. EP 133011, EP 133012, EP 144247, EP 227094, EP 228066.

For example, the receiving layer can be constituted of a resin mixture of a (co)polyester according to the present invention and a conventional (co)polyester resin.

When the present (co)polyester resin is used in combination with another resin, the amount of the other resin, although it depends on the present (co)polyester used, is preferably 0 to 100 parts by weight per 100 parts by weight of the present (co)polyester resin.

High boiling organic solvents or thermal solvents or plasticizers can be included in the image-receiving layer, as substances which can accept or dissolve the dyes or as diffusion promoters for the dyes. Useful examples of such high boiling organic solvents and thermal solvents include the compounds disclosed in, for example, JP 62/174754, JP 62/245253, JP 61/209444, JP 61/200538, JP 62/8145, JP 62/9348, JP 62/30247, JP 62/136646.

For the purpose of improving the whiteness of the receiving layer to enhance sharpness of the transferred image and also imparting writability to the receiving surface as well as preventing retransfer of the transferred image, a white pigment can be added to the receiving layer. As the white pigment, titanium oxide, zinc oxide, kaolin, clay, calcium carbonate, fine powdery silica, etc. can be employed, and these can be used as a mixture of two or more kinds as described above.

Also, for further enhancing the light resistance of the transferred image, one or two or more kinds of additives such as UV-ray absorbers, light stabilizers and antioxidants, can be added, if necessary. The amounts of these UV-ray absorbers and light stabilizers is preferably 0.05 to 10 parts by weight and 0.5 to 3 parts by weight, respectively, per 100 parts of the resin constituting the receiving layer.

The dye receiving element of the present invention can contain a release agent for improvement of the release property with respect to the donor element. As the release agent, solid waxes such as polyethylene wax, amide wax, and Teflon powder; fluorine based and phosphate ester based surfactants; and paraffin based, silicone based and fluorine based oils. Silicone oils, preferably reactive silicone oils and silicone containing copolymers such as a polysiloxane-polyether copolymer, are preferred.

Also, on at least a part of the surface of the image receiving layer, a release agent can be provided by applying a coating of a solution or a dispersion of the above release agent in an appropriate solvent and then carrying out drying and other steps. The thickness of the release layer is preferably 0.01 to 5 μm, particularly 0.05 to 2 μm.

Formation of the receiving layer may be practiced, not only by a known coating or printing method, but also by first coating the receiving layer composition obtained by dissolving or dispersing the appropriate materials on a separate temporary carrier and then transferring it therefrom to the permanent support.

As the support for the receiver sheet it is possible to use a transparant film or sheet of various plastics such as polyethylene terephthalate, polyolefin, polyvinyl chloride, polystyrene, polycarbonate, polyether sulfone, polyimide, cellulose ester or polyvinyl alcohol-co-acetal. The support may also be a reflective one such as paper (top quality paper, art paper, cellulose fiber paper), baryta-coated paper, polyolefin-coated paper, e.g. dual polyethylene-coated paper, synthetic paper (polyolefin type, polystyrene type) or white polyester i.e. white-pigmented polyester.

Also, a laminated product by any desired combination of the above can be used. Typical examples of the laminates include a laminate of cellulose fiber paper and synthetic paper and a laminate of cellulose fiber paper and a plastic film or sheet. As further examples of the laminates, a plastic film can be used with synthetic paper instead of cellulose fiber paper. Further, a laminate of cellulose fiber paper, plastic film and synthetic paper can also be used.

The support sheet serves to support the dye receiving layer, and it is desirable that the support sheet has mechanical strength sufficient enough to handle the dye receiving sheet which is heated at the time of heat transfer recording. If the dye-receiving layer alone has the necessary mechanical strength, the support sheet may be omitted.

The dye-receiving layer of the present invention preferably has an overall thickness of from 0.5 to 50 μm, more preferably from 2.5 to 10 μm, when the dye-receiving layer is provided on a support sheet, or preferably, from 3 to 120 μm when a support sheet is omitted.

The image receiving layer may be a single layer, or two or more such layers may be provided on the support.

Also receiving layers may be formed on both surfaces of the support. In the case of a transparant support recto-verso printing on both receiving layers as described in European Patent Application No. 90200930.7 then leads to an increase in density of the transferred image.

The image receiving element of the present invention may also have one or more intermediate layers between the support and the image receiving layer. Depending on the material from which they are formed, the intermediate layers may function as cushioning layers, porous layers, or dye diffusion preventing layers, or may fulfill two or more of these functions, and they may also serve the purpose of an adhesive, depending on the particular application.

The material constituting the intermediate layer may include, for example, urethane resin, acrylic resin, ethylenic resin, butadiene rubber, or epoxy resin. The thickness of the intermediate layer may preferably be about 2 to 20 μm.

Dye diffusion preventing layers are layers which prevent the dye from diffusing into the support. The binders used to form these layers may be water soluble or organic solvent soluble, but the use of water soluble binders is preferred, and especially gelatin is most desirable.

Porous layers are layers which prevent the heat which is applied at the time of thermal transfer from diffusing from the image receiving layer to the support to ensure that the heat which has been applied is used efficiently.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina for example, can be included in the image receiving layers, cushioning layers, porous layers, diffusion preventing layers and adhesive layers, etc. constituting the thermal transfer image receiving element of the present invention.

Also, the image receiving element of the present invention can have antistatic treatment applied to the front or back surfaces thereof. Such antistatic treatment may be carried out by incorporating an antistatic agent in, for example, the image receiving layer which becomes the front surface or in an antistatic preventive layer applied to the image receiving surface. A similar treatment can also be effected to the back surface. By such treatment, mutual sliding between the image receiving sheets can be smoothly performed, and there is also the effect of preventing the attachment of dust on the image receiving sheet.

Furthermore, the image receiving sheet can have a lubricating layer provided on the back surface of the sheet support. The material for the lubricating layer may include methacrylate resins such as methyl methacrylate, etc. or corresponding acrylate resins, vinyl resins such as vinyl chloride-vinyl acetate copolymer.

The receiving element can have detection marks provided on one surface, preferably the back surface so that the receiving element can be accurately set at a desired position during transfer, whereby the image can be formed always at a correct desired position.

A dye-donor element for use according to thermal dye sublimation transfer in combination with the present receiving element usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

The dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 um, preferably 0.4 to 2.0 um, and the ratio of dye to binder is between 9:1 and 1:3 by weight, preferably between 2:1 and 1:2 by weight.

As polymeric binder the following can be used: cellulose derivatives, such as ethyl cellulose, hydroxyethyl cellulose, ethylhydroxy cellulose, ethylhydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or copolystyrene-acrylonitrile is used as binder for the dye layer.

Any dye can be used in such a dye layer provided it is easily transferable to the dye-image-receiving layer of the receiver sheet by the action of heat.

Typical and specific examples of dye for use in thermal dye sublimation transfer have been described in, e.g., EP 400706, EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, U.S. Pat. No. 4,743,582, U.S. Pat. No. 4,753,922, U.S. Pat. No. 4,753,923, U.S. Pat. No. 4,757,046, U.S. Pat. No. 4,769,360, U.S. Pat. No. 4,771,035, JP 84/78894, JP 84/78895, JP 84/78896, JP 84/227490, JP 84/227948, JP 85/27594, JP 85/30391, JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

Particularly preferred dyes or dye mixtures for use in the primary color dye-donor elements are for yellow a mixture of a dye corresponding to the formula

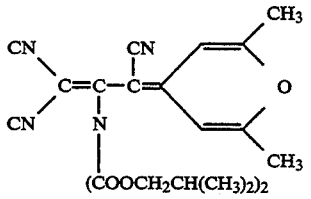

and a dye corresponding to the formula

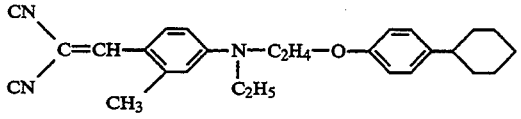

in a ratio of 1:10 to 10:1, for magenta a mixture of a dye corresponding to the formula

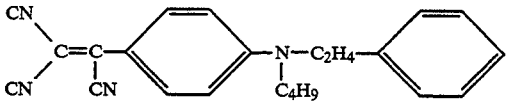

and a dye corresponding to the formula

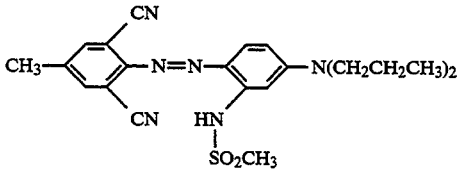

in a ratio of 1:10 to 10:1, or a mixture of a dye corresponding to the formula

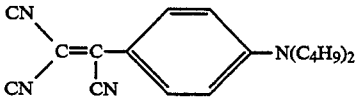

and a dye corresponding to the formula

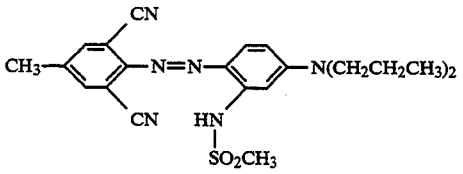

in a ratio of 1:10 to 10:1, for a cyan a mixture of a dye corresponding to the formula

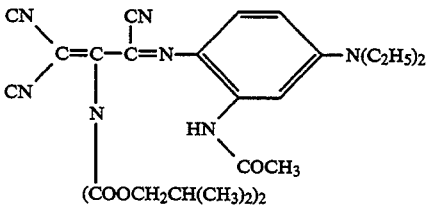

and a dye corresponding to the formula

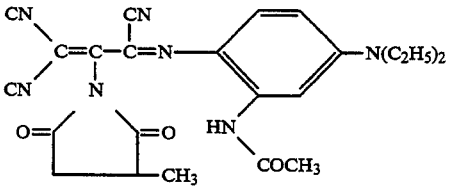

in a ratio of 1:10 to 10:1, and for black a mixture of a magenta dye corresponding to the formula

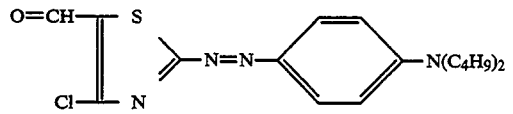

and a cyan dye corresponding to the formula

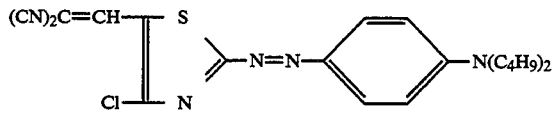

and a yellow dye corresponding to the formula

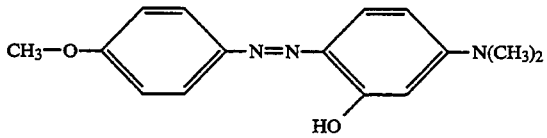

The binder that is preferably used in said primary color dye layers is a mixture of co-styrene-acrylonitrile and co-styrene-acrylonitrile-butadeen in a ratio ranging from 0 to 100% of either of the constituents. Preferably the binder/dye ratio is between 5:1 and 1:5.

The coating layer may also contain other additives, such as curing agents, preservatives, organic or inorganic fine particles, dispersing agents, antistatic agents, defoaming agents, viscosity controlling agents, etc., these and other ingredients being described more fully in EP 133011, EP 133012, EP 111004 and EP 279467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a polyethylene terephthalate support. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phophates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. No. 4,567,113, U.S. Pat. No. 4,572,860, U.S. Pat. No. 4,717,711. Preferably the slipping layer comprises as binder a styrene-acrylonitrile copolymer or a styrene-acrylonitrile-butadiene copolymer or a mixture thereof and as lubricant in an amount of 0.1 to 10% by weight of the binder (mixture) a polysiloxane-polyether copolymer or polytetrafluoroethylene or a mixture thereof.

The dye layer of the dye-donor element may also contain a releasing agent that aids in separating the dye-donor element from the dye-receiving element after transfer. The releasing agents can also be applied in a separate layer on at least part of the dye layer. For the releasing agent solid waxes, fluorine- or phosphate-containing surfactants and silicone oils are used. Suitable releasing agents are described in e.g. EP 133012, JP 85/19138, EP 227092.

The dye-receiving elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In order to accomplish a perfect register when the process is performed for more than one color and in order to detect what color is existing at the printing portion of the donor element, detection marks are commonly provided on one surface of the donor element. Generally optically detectable marks are used that can be detected by a light source and a photo sensor; detection can be done by measuring the light transmitted through the detection mark or reflected from said mark. The marks being in the form of a light-absorbing or light-reflecting coating are formed in a preassigned position on the donor element by e.g. gravure printing. The detection marks can comprise an infrared absorbing compound such as carbon black. The detection mark can also comprise one of the image dyes that are used for the image formation, with the detection being in the visible range.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLE 1: Synthesis of Polyester Resin No. 1

A mixture of 0.42 mole of terephthalic acid dimethyl ester, 0.37 mole of isophthalic acid dimethyl ester, 0.16 mole of 5-sulfoisophthalic acid dimethyl ester sodium salt and 1.7 mole of ethyleneglycol, 0.21 mole of Dianol 22 (supplied by Akzo) and 0.1 mole of 12-hydroxystearic acid together with 0.0002 mole of zinc acetate and 0.0001 mole of antimony III oxide was melted in a reactor under nitrogen atmosphere and stirred at 200° C.

The esterification started rapidly and methanol and water was distilled off. During about 60 to 90 minutes the temperature was raised to 255° C. and the theoretical amount of methanol and water was distilled off. The reaction product was condensed under reduced pressure in 60 to 120 minutes at 255°–280° C. until the desired polymerization degree was obtained. The excess of ethyleneglycol was distilled off during the condensation reaction.

Yield of the condensation was 100%.

Intrinsic viscosity (concentration of 0.5%): 0.10–0.40 dl/g measured in a mixture of phenol/dichlorobenzene (60/40) at 250° C.

Other polyester resins according to the present invention such as those listed in Table 1 can be prepared according to the above method.

EXAMPLE 2: Preparation of the Image-receiving Element

A 10 wt % aqueous polyester dispersion was applied to the support material (polyethylene coated paper) by bar coating in a wet thickness of 20 μm and dried at 40° C. and further dried at 90° C. for 30 minutes.

Image receiving elements comprising the polyester resins identified in Table 2 below were prepared in this manner.

EXAMPLE 3: Evaluation of the Image-receiving Element

A commercially available Mitsubishi material type CK 1005 was used as dye donor element.

The obtained dye receiving element was printed in combination with the dye-donor element in a Mitsubishi video printer type CP 100 so as to form a black image by superposition of yellow, magenta and cyan images.

The receiver sheet was separated from the dye-donor element and the color density of the recorded black image on the receiving sheet was measured by means of a Macbeth RD919 densitometer.

This experiment was repeated for each of the polyester resins identified in Table 2. As a result thereof black colored records of color densities shown in Table 2 were obtained.

TABLE 2

| Resin No. | D |
|---|---|
| 1 | 2.06 |
| 2 | 1.98 |
| 3 | 2.07 |
| 4 | 2.13 |
| 5 | 2.05 |

These results show that high densities are obtained with the present polyester image receiving layers.

In addition the anti-sticking properties of the image receiving layer without using a releasing compound in the receiving layer or in a toplayer are improved.

We claim:

1. Dye-image receiving element for use according to thermal dye sublimation transfer comprising a support having thereon a dye-image receiving layer containing a (co)polyester obtained by condensation of one or more diols, one or more dicarboxylic acids, and one or more hydroxy-carboxylic acids containing a long chain alkyl or alkylene group having at least 8 carbon atoms.

2. Dye-image receiving element according to claim 1, wherein the long chain alkyl or alkylene group has at least 10 carbon atoms.

3. Dye-image receiving element according to claim 1, wherein the long chain alkyl or alkylene group is branched.

4. Dye-image receiving element according to claim 3, wherein the branching contains at least 6 carbon atoms in the side chain.

5. Dye-image receiving element according to claim 1, wherein the long chain alkyl or alkylene group is incorporated in a side-chain of the hydroxy-carboxylic acid.

6. Dye-image receiving element according to claim 1, wherein the said hydroxy-carboxylic acid is 12-hydroxystearic acid or ricinoleic acid.

7. Dye-image receiving element according to claim 1, wherein one or more of said dicarboxylic acids is an aromatic dicarboxylic acid and one or more of said diols is an aliphatic diol.

8. Dye-image receiving element according to claim 7, wherein the aromatic dicarboxylic acids are one or more dicarboxylic acids selected from the group consisting of terephthalic acid, isophthalic acid and 5-sulfoisophthalic acid sodium salt and wherein the aliphatic diol is ethylene glycol.

9. Dye-image receiving element according to claim 1, wherein the (co)polyester contains a solubilizing group.

10. Dye-image receiving element according to claim 1, wherein one or more of said dicarboxylic acids or one or more of said diols contains a long chain alkyl or alkylene group.

* * * * *